US007589295B2

(12) United States Patent
Gaudart

(10) Patent No.: US 7,589,295 B2
(45) Date of Patent: Sep. 15, 2009

(54) ELECTRICAL SWITCHGEAR

(75) Inventor: Georges Gaudart, Voreppe (FR)

(73) Assignee: Siemens Aktiengesellschaft, Munich (DE)

( * ) Notice: Subject to any disclaimer, the term of this patent is extended or adjusted under 35 U.S.C. 154(b) by 321 days.

(21) Appl. No.: 11/665,873

(22) PCT Filed: Jul. 20, 2006

(86) PCT No.: PCT/EP2006/064445

§ 371 (c)(1),
(2), (4) Date: Apr. 19, 2007

(87) PCT Pub. No.: WO2007/014865

PCT Pub. Date: Feb. 8, 2007

(65) Prior Publication Data

US 2008/0093344 A1 Apr. 24, 2008

(30) Foreign Application Priority Data

Jul. 29, 2005 (EP) ..... 05107046

(51) Int. Cl.
*H01H 33/02* (2006.01)

(52) U.S. Cl. ..... 218/4; 218/136; 218/144

(58) Field of Classification Search ..... 218/2–6, 218/69, 70, 77, 82, 136–138, 144, 145
See application file for complete search history.

(56) References Cited

U.S. PATENT DOCUMENTS 3,470,341 A * 9/1969 Beddoe ..... 218/4
3,541,284 A 11/1970 Wachta
3,786,216 A 1/1974 Beier et al.
3,953,693 A 4/1976 Pflanz
4,103,128 A * 7/1978 Kosaku ..... 218/145
5,039,831 A * 8/1991 Sato et al. ..... 218/144
5,451,731 A * 9/1995 Yoshizumi et al. ..... 218/143
5,728,989 A 3/1998 Utsumi et al.
6,683,267 B1 * 1/2004 Piazza et al. ..... 218/2

FOREIGN PATENT DOCUMENTS

DE 41 29 008 A1 1/1992
EP 0 335 338 A2 10/1989
GB 1067481 5/1967

* cited by examiner

*Primary Examiner*—Elvin G Enad
*Assistant Examiner*—Marina Fishman
(74) *Attorney, Agent, or Firm*—Laurence A. Greenberg; Werner H. Stemer; Ralph E. Locher

(57) ABSTRACT

Electrical switchgear, such as a circuit breaker, must in general provide good dielectric strength in open position in order to avoid discharge. To improve the dielectric strength capacitors are often arranged in parallel between the contacts of the switchgear. For very high voltage applications, for example >500 kV, two circuit breaker are connected in series for switching such high voltages, i.e. the total voltage to be switched needs to be shared equally by the two switches. Because of the required capacitance the capacitor and hence also the switchgear is large, especially of great diameter, and costly. The novel device provides for shields arranged in order to form additional capacitors C1", C1'" and $C_2$ between the shields and between a connector, connecting the two switches, and the enclosure. The resulting switchgear 1 has increased dielectric strength and the total voltage is substantially equally shared by the two switches in series.

10 Claims, 2 Drawing Sheets

ELECTRICAL SWITCHGEAR

BACKGROUND OF THE INVENTION

FIELD OF THE INVENTION

The present invention is pertaining to an electrical switchgear with two switches arranged in the switchgear enclosure and electrically connected in series whereat each of the switches comprises a first and second contact, at least one of the first and second contact of each switch being a mobile contact, the first contacts of the two switches are mechanically and electrically connected by means of a connecting means, the first contact of a switch is at least partially surrounded by a first electrical conductive shield and the second contact of the switch is at least partially surrounded by a second electrical conductive shield.

Electrical switchgear, e.g. a circuit breaker, must in general provide good dielectric strength in open position in order to avoid breakthrough by arcing between the separated contacts or between a contact and a grounded part of the switchgear, like the grounded switchgear enclosure. To improve the dielectric strength capacitors are often arranged in parallel between the contacts of the switchgear. Due to the required capacitances which make the capacitor big and heavy such switchgear requires a lot of space. For very high voltage applications, e.g. >500 kV, two circuit breaker are connected in series for switching such high voltages, i.e. the voltage to be switched needs to be shared by the two switches. For such double chamber circuit breaker each circuit breaker is provided with a capacitor connected in parallel between the contacts of each switch for improving dielectric strength. Such a double chamber circuit breaker is shown in U.S. Pat. No. 3,786,216 A. Some arrangements of prior art show either capacitors made by solid isolators integrated into single-chamber circuit breaker (allowing transitory voltage to be reduced particularity when short-line fault occur) and into two-chamber circuit-breaker (allowing to share the voltage equally by the chambers) or shields, e.g. made by metallic sheets, around the chambers for dielectric purposes.

Examples of such switchgears are given in U.S. Pat. No. 5,728,989 A or EP 335 338 A2. U.S. Pat. No. 3,953,693 A shows a vacuum switch with integrated capacitor shields. Such vacuum switches can be used in series using the integrated capacitors to assure proper voltage distribution between the switches. The integrated capacitors are also effective as shields and serve as a labyrinth to shield against diffusions of arc products. To this end a number of shields are arranged labyrinth-like to form a labyrinth passage which effectively intersects arc particles which are generated on separation of the contacts. To form a labyrinth a great number of such shields are required which leads to a costly design with great dimensions, especially diameters. Each switch is arranged in its own enclosure of insulating material.

It is also known from prior art, e.g. from U.S. Pat. No. 3,541,284 A, to employ a capacitor made of two tubular, concentric and partly overlapping shields in parallel to an electrical single-chamber switch to increase the inherent capacitance of the single-chamber switch, and consequently also its dielectric strength.

Hence, it is an object of the present invention to provide a compact double-chamber switchgear for high voltage applications with improved dielectric strength and good voltage distribution between the two serially connected switches of the switchgear.

This object is achieved by arranging the first and second shield such that a shield capacitor is formed between the first and second shield, by arranging the second shield that partially surrounds the connecting means so that a further capacitor is formed between the second shield and the connecting means and in that a second capacitor is formed between the, preferably grounded, enclosure of the switchgear and a connecting means.

Such an arrangement increases the dielectric strength of the electrical switchgear significantly by increasing the natural capacitor between the open contacts of the switch thus reducing the risk of breakthrough and discharges when the switchgear is in open position. Since no bulky capacitors are required to improve the dielectric strength such a switchgear can be of compact design and reduced overall dimensions, especially of reduced enclosure diameter. This means that the switchgear requires less space which is especially advantageous. Furthermore, since the costs of the shields are small compared to classical capacitors, such a switchgear is also cheaper than conventional ones. The large surface of the shields act also as radiative surface which increases the thermal capability of the switchgear and which is also advantageous for temperature rise tests.

SUMMARY OF THE INVENTION

The dielectric strength of the switchgear is further increased, if the second shield is at least partially surrounding the connecting means so that a further capacitor is formed between the second shield and the connecting means. The further capacitor is parallel to the shield capacitor and the natural capacitance of the switch and increases consequently directly the capacitance of the switch further. Indeed, according to the example described below, the fact that the second shield (11) is at least partially surrounding the connecting means (4) so that a further capacitor ($C_1'''$) is formed between the second shield (11) and the connecting means (4) is very relevant for the invention, because this increases capacitor $C_1$ (being $C_1'+C_1''+C_1'''$), and decreases capacitor $C_2$, and thus improves voltage distribution between the two switching units, while the voltage ratio is $C_1/(C_2+2C_1)$ and thus its value tends towards ½.

An especially compact design can be achieved when the connecting means is at least partially a drive unit for driving the mobile contact. This allows a very compact design of small diameters. The connecting means can also be at least partially the first shield which may in an advantageous embodiment extend from the first contact of the first switch to the first contact of the second switch.

If the ratio between the capacitances of second and first capacitor is less than 0.5, preferably less than 0.1 and especially less than 0.05, then the total voltage to be switched is substantially equally shared by the two switches.

The invention is described in the following with reference to FIGS. 1 to 3 showing in exemplary, non-limiting way

DESCRIPTION OF THE PREFERRED EMBODIMENTS

Figure 1:
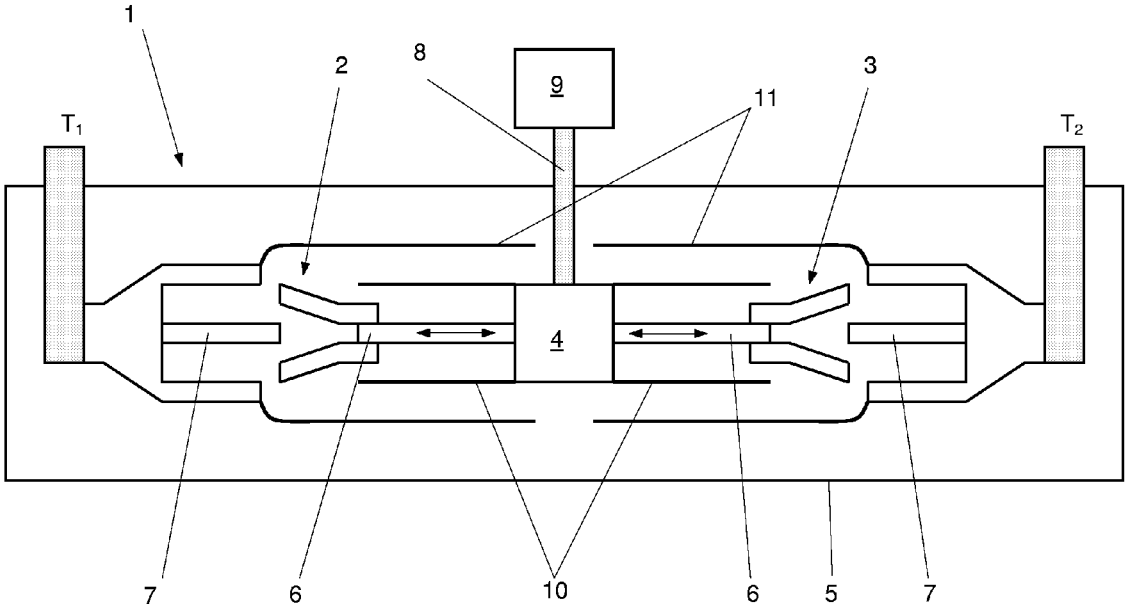
FIG. 1 a schematic drawing of an electrical switchgear according to an embodiment of the invention, FIG. 2 a schematic drawing of the capacitors formed according to the invention and FIG. 3 an electric circuit diagram of the electrical switchgear.

The inventive electrical switchgear 1, e.g. a circuit breaker, is shown in FIG. 1 and comprises an enclosure 5 into which two switches 2, 3 are arranged. The two switches 2, 3 are connected in series between two terminals $T_1$ (e.g. high potential) and $T_2$ (e.g. ground) by a connecting means 4. In order to perform a switching operation (open or close) a mobile contact 6 (indicated by the double arrow in FIG. 1) of both switches 2, 3 is moved simultaneously by means of a drive unit acting also as connecting means 4 for mechanically and electrically connecting the two switches 2, 3. The drive unit 4 is arranged between the switches 2, 3 and may comprise a number of levers and a driving rod 8 mechanically connecting the drive unit 4 to a driving mechanism 9, in this example located outside the enclosure 5, as shown in FIG. 1. The drive unit 4 can be driven by a suitable driving mechanism 9, like e.g. a well-known spring mechanism, hydraulic mechanism or motor drive. The driving rod 8 itself may be of insulating material. The drive unit 4 is mechanically connected to a mobile contact 6 of each switch 2, 3, thus driving the mobile contacts 6. A second contact 7 of each switch 2, 3 is either fixed or could also be moveable to form a double acting circuit breaker. But basically, any other suitable drive unit or any other arrangement of one or more drive units could be employed as well, it would e.g. be possible that both contacts are moveable contacts and/or that each switch has its own drive unit.

To allow an electrical connection between the terminals $T_1$ and $T_2$ of the switchgear 1, the second contact 7 of the first switch 2 is connected to terminal $T_1$, e.g. the high voltage terminal. In closed position the first 6 and second contacts 7 of switches 2, 3 are in contact and the first contact 6 of the first switch 2 is electrically connected to the connecting means 4, in this example the drive unit, which is again electrically connected to the first contact 6 of the second switch 3 and hence, via second contact 7 of the second switch 3 also to terminal $T_2$, e.g. the grounded terminal. In open position of the switches 2, 3 the contacts 6, 7 are separated and the electrical connection is interrupted.

The switches 2, 3 must have sufficient dielectric strength (i.e. the ability to withstand the maximum nominal voltage of the switchgear 1 without electric breakthrough) in order to prevent arcing between the two contacts 6, 7 in open position. In order to increase the dielectric strength of the switches 2, 3 or to allow a more compact design of the switchgear 1, the enclosure 5 could also be filled with insulating gas, e.g. like $SF_6$. In conventional circuit breakers capacitors are often connected in parallel to the contacts of the switch which further increases the dielectric strength of the switch, as is well-known.

The following is described with reference to only one of the switches 2, 3 of the switchgear 1 because of the symmetrical arrangement of the switches 2 and 3.

The first contact 6 is partially surrounded by a first shield 10. The first shield 10 is made of electrical conductive material and is electrically connected to the first contact 6 and hence also to the connecting means 4 (in this example the drive unit). Consequently, first shield 10 has the same electrical potential as first contact 6. An electrical conductive second shield 11 is arranged in the enclosure 5 such that it is electrically connected to the second contact 7, thus having the same electrical potential as second contact 7, and that it is at least partially surrounding the first contact 6 and the first shield 10. The second shield 11 may also surround at least partially the connecting means 4, here the drive unit, as indicated in FIG. 1. But it would also be possible that the first shield 10 itself is at least partially the connecting means 4, e.g. by providing only one shield 10 which extends from the first contact 6 of the first switch 2 to the first contact 6 of the second switch 3. In this case the electrical connection between the two switches 2, 3 is at least partially formed by the shield 10.

Figure 2:
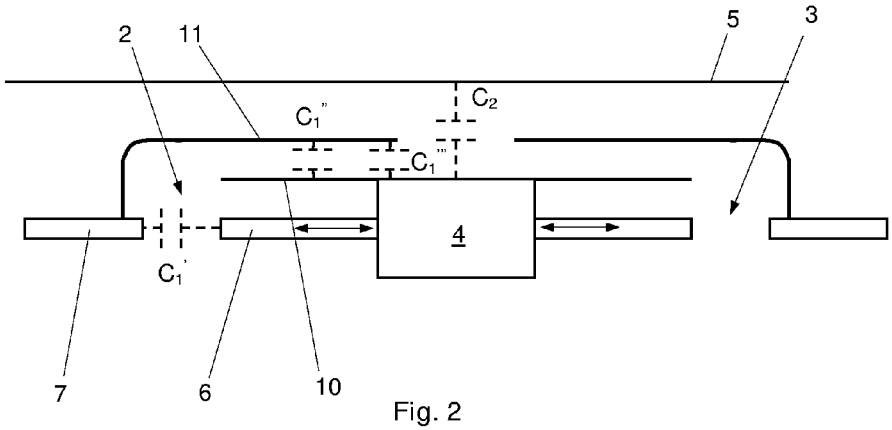

Due to the arrangement of the shields 10, 11, additional capacitors are formed as is schematically shown in FIG. 2. Between the first (in this example mobile) contact 6 and the second (in this example fixed) contact 7 the natural capacitor $C_1'$ is formed between the two open contacts 6, 7. Between first shield 10 and second shield 11 a shield capacitor $C_1''$ is formed and between second shield 11 and connecting means 4, e.g. the drive unit, a capacitor $C_1'''$ is formed. Since these three capacitors are connected in parallel, the capacitors can be combined to a first capacitor $C_1=C_1'+C_1''+C_1'''$. Therefore, the natural capacitance of the switch 2 is increased and hence also the dielectric strength of the open switch 2. The longer the shields 10, 11 become, the greater the capacitance of capacitor $C_1''$ will be. The more the second shield 11 extends also over the connecting means 4, the greater the capacitance of capacitor $C_1'''$ will be. Since a compact design of the switchgear 1 is desired it is advantageous to arrange first and second shield 10, 11 as close together as possible, whereat the minimum distance is basically defined by the maximum voltage of the switchgear 1 and the media inside the enclosure 5 (e.g. $SF_6$) which acts as insulator for the capacitors $C_1$ and $C_2$.

Furthermore, a second capacitor $C_2$ is formed between the grounded enclosure 5 and the connecting means 4, e.g. the drive unit, which has the same electrical potential as the first contacts 6 of the switches 2, 3. The capacitance of capacitor $C_2$ is the smaller, the more the second shield 11 extends over connecting means 4 and the shorter the connecting means 4 is.

Figure 3:
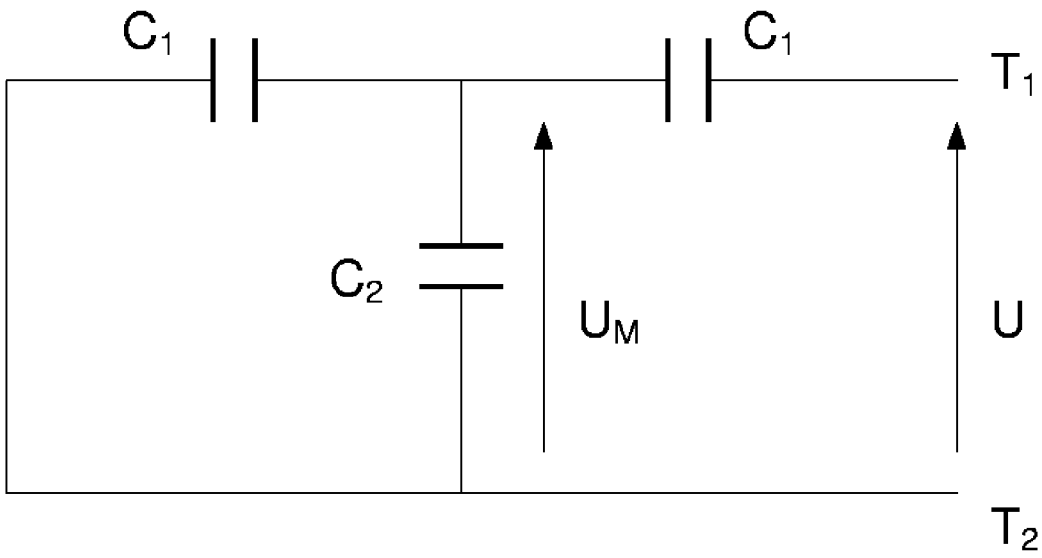

The resulting potential between the two switches 2, 3 can easily be derived from the equivalent circuit diagram of the electrical switchgear 1 shown in FIG. 3. The closed switches are not shown in FIG. 3. Employing basic physical relationships, the middle voltage $U_M$ (i.e. the voltage between the first contacts 6 and terminal $T_2$) can be found as $U_M=C_1/(C_2+2C_1)\cdot U$, with U being the voltage between the terminals $T_1$ and $T_2$. From this equation it can gathered that the middle voltage $U_M$ is approximately U/2 if $C_1>>C_2$. Therefore, it can be achieved that the total voltage to be switched is substantially equally shared by the two switches 2, 3 connected in series by making the capacitance of capacitor $C_1$ as big as possible and of capacitor $C_2$ as small as possible.

In an example the geometry of the switches 2, 3 and the shields 10, 11 (e.g. length, distance) can be chosen so that the capacitance of the first capacitor $C_1$ is 250 pF and the capacitance of the second capacitor $C_2$ to the earthed enclosure 5 is 20 pF. This would lead to a middle voltage $U_M=0.48\cdot U$ which means that both switches 2, 3 would have about the same voltage to switch.

Generally, $C_2$ should be less than $0.5\cdot C_1$, preferably less than $0.1\cdot C_1$, especially less than $0.05\cdot C_1$, to achieve a good voltage distribution.

From the above it can be followed, that it is advantageous to make the second shield 11 as long as possible and especially to extend shield 11 also over the connecting means 4 since this would increase $C_1''$ and $C_1'''$ (and hence also $C_1$) and would decrease $C_2$.

I claim:

1. Electrical switchgear, comprising:

first and second switches disposed in a switchgear enclosure and electrically connected in series;

each of said switches having a first contact and a second contact, at least one of said first and second contacts of each said first and second switches being a mobile contact;

connecting means mechanically and electrically connecting said first contacts of said first and second switches to one another;

a first electrical conductive shield at least partly surrounding said first contact of at least one of said switches and being electrically connected to said first contact;

a second electrical conductive shield at least partly surrounding said second contact of said at least one of said switches, said second shield being electrically connected to said second contact and at least partially surrounding said first shield, thereby forming a shield capacitor between said first shield and said second shield;

said second shield at least partially surrounding said connecting means and forming a further capacitor between said second shield and said connecting means, and wherein a second capacitor is formed between said enclosure and said connecting means.

2. The electrical switchgear according to claim 1, wherein said enclosure is electrically grounded.

3. The electrical switchgear according to claim 1, wherein said connecting means comprises a drive unit for driving said mobile contact.

4. The electrical switchgear according to claim 1, wherein said connecting means is at least partially formed by said first shield.

5. The electrical switchgear according to claim 1, wherein said first shield extends from said first contact of said first switch to said first contact of said second switch.

6. The electrical switchgear according to claim 1, wherein a ratio between a capacitance of said second capacitor and a capacitance of said first capacitor is less than 0.5.

7. The electrical switchgear according to claim 6, wherein the ratio between the capacitance of said second capacitor and the capacitance of said first capacitor is less than 0.1.

8. The electrical switchgear according to claim 6, wherein the ratio between the capacitance of said second capacitor and the capacitance of said first capacitor is less than 0.05.

9. Electrical switchgear, comprising:

first and second switches disposed in a switchgear enclosure and electrically connected in series;

each of said switches having a first contact and a second contact, with at least one of said first and second contacts movably disposed relative to the other of said first and second contacts;

connecting means mechanically and electrically connecting said first contacts of said first and second switches to one another;

a first electrical conductive shield at least partly surrounding said first contact of each of said switches and being electrically connected to said first contact;

a second electrical conductive shield at least partly surrounding said second contact of each of said switches and being electrically connected to said second contact, said second shield at least partially surrounding said first shield and forming a shield capacitor therewith;

said second shield at least partially surrounding said connecting means and forming a further capacitor between said second shield and said connecting means, and wherein a second capacitor is formed between said enclosure and said connecting means.

10. The electrical switchgear according to claim 9, wherein said enclosure is electrically grounded.

* * * * *